United States Patent [19]

Liepins et al.

[11] 4,164,929

[45] Aug. 21, 1979

[54] PROJECTILE LOADER FOR GUN

[75] Inventors: Sigurds Liepins, Rushville; James W. Crane, Fairport, both of N.Y.

[73] Assignee: The Coleman Company, Inc., Wichita, Kans.

[21] Appl. No.: 814,438

[22] Filed: Jul. 11, 1977

[51] Int. Cl.[2] ..... F41B 11/06; F41F 1/04

[52] U.S. Cl. ..... 124/76; 124/50; 124/82

[58] Field of Search ..... 124/41 R, 41 C, 48, 124/50, 45, 51 R, 52, 53, 67, 68, 74, 75, 76, 77, 82; 42/15, 23, 24, 39.5; 40/17, 18

[56] References Cited

U.S. PATENT DOCUMENTS

| | | | |
|---|---|---|---|
| 2,732,644 | 1/1956 | Graf | 40/17 |
| 3,261,341 | 7/1966 | Merz | 124/74 |
| 3,502,061 | 3/1970 | Yoo | 124/76 X |
| 3,572,310 | 3/1971 | Chiba | 124/76 |
| 3,628,272 | 12/1971 | Van Langenhoven | 42/39.5 |
| 3,782,359 | 1/1974 | Kester et al. | 124/48 |
| 3,913,553 | 10/1975 | Braughler et al. | 124/73 |
| 4,004,565 | 1/1977 | Fischer et al. | 124/45 |

FOREIGN PATENT DOCUMENTS

| | | | |
|---|---|---|---|
| 527942 | 4/1954 | Belgium | 42/39.5 |

*Primary Examiner*—Richard T. Stouffer

*Attorney, Agent, or Firm*—Tilton, Fallon, Lungmus & Chestnut

[57] ABSTRACT

A removable projectile loader for a gun facilitates loading a gun with a projectile and is removable from the gun to permit a jammed projectile to be cleared from the gun. The loader is provided with a bore into which a projectile is loaded, and the loader is movable to a firing position to align the bore with the barrel of the gun. A bolt on the gun is movable through the bore of the loader into the barrel to position the projectile in the barrel for firing.

5 Claims, 9 Drawing Figures

FIG. 3
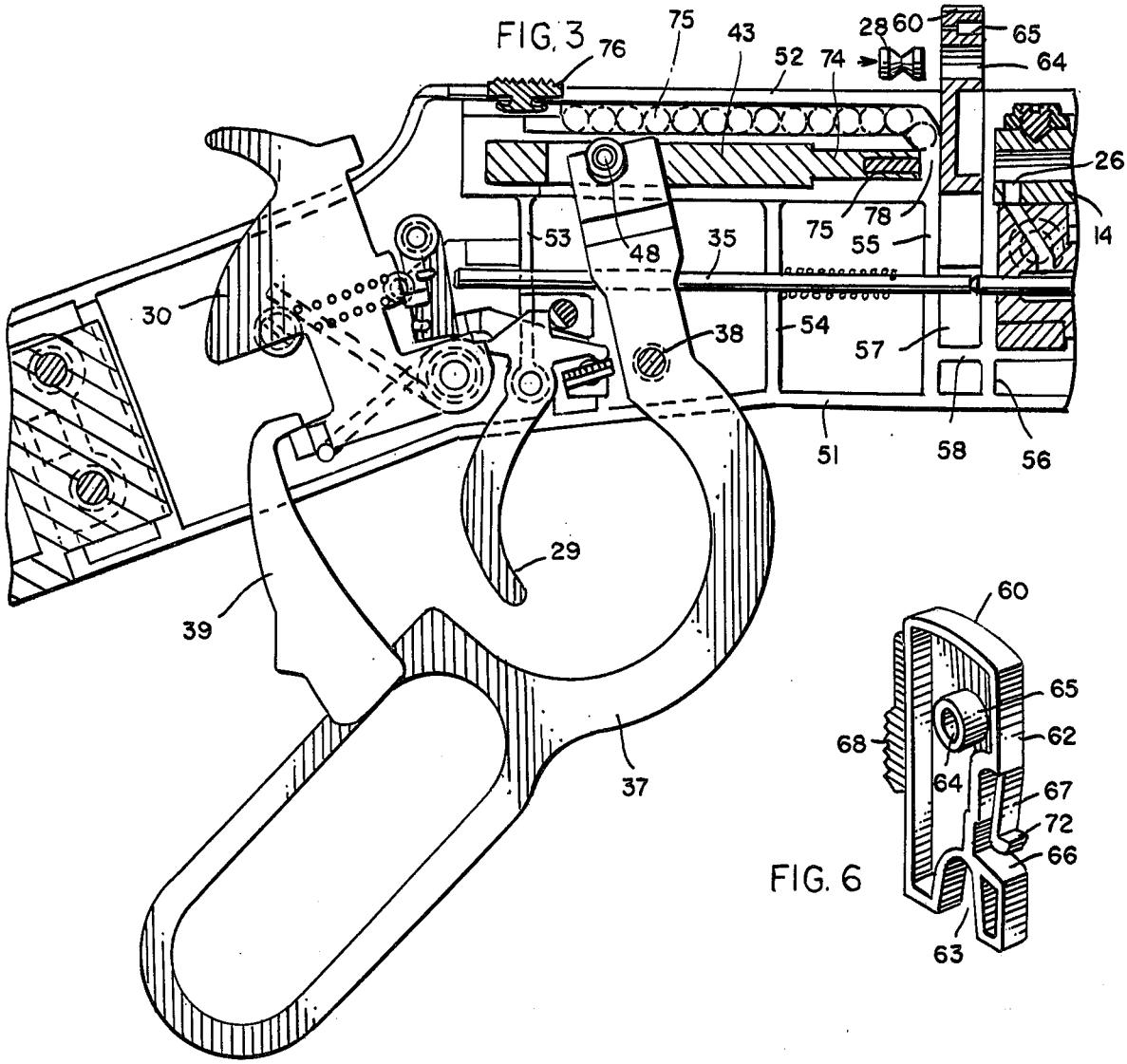
FIG. 6
FIG. 7
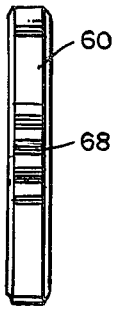
FIG. 8
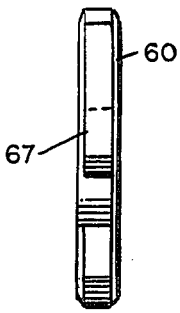
FIG. 9
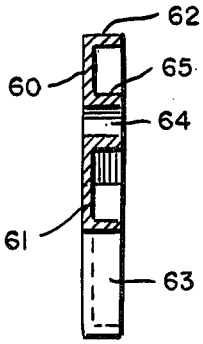

PROJECTILE LOADER FOR GUN

BACKGROUND OF THE INVENTION

This invention relates to a projectile loading mechanism for a gun, and, more particularly, to a loading mechanism which is easily removable from the gun, which cooperates with the bolt of the gun to position the projectile in the gun barrel for firing, and which does not interfere with the ability of the gun to operate as a repeater.

The invention finds particular utility with air or $CO_2$ gas powered guns and will be explained in conjunction therewith. As used herein, the term "gas" includes both air and $CO_2$ as well as other gases which could be utilized to fire projectiles. Gas powered guns fire a projectile, usually a BB or a pellet, with a burst of pressurized gas. Some guns may be designed to shoot only BB's or pellets, and other guns may be adapted to shoot both BB's and pellets.

A gun which shoots BB's often has a magazine or chamber for storing a number of BB's which are fired successively from the gun each time the firing mechanism of the gun is cocked and fired. A gun capable of operating in this manner may be called a repeater.

Although some pellet guns have repeater action, may pellet guns operate on single shot action, i.e., a pellet must be manually loaded into the gun each time the gun is fired. Single shot guns are therefore sometimes equipped with a loading device which facilitates loading a single projectile into the gun.

One particular prior art loading device is used with a target pistol. The loading device is a generally cylindrical plug which is slidably mounted in the barrel of the gun for movement in a direction generally transverse to the axis of the barrel. The plug is provided with a bore which is aligned with the barrel when the plug is in its firing position and which is positioned above the barrel when the plug is in its loading position. Certain problems arise, however, from the use of this loading device. The loader is spring-biased to its loading position and requires a rather complex latching and alignment mechanism for maintaining the loading device in the firing position. Since the pellet is fired from the loading device rather than from the barrel, the bore of the loader must be accurately aligned with the bore of the barrel. A slight misalignment between the two bores can damage the gun and cause jamming. Further, propellant gas can leak between the loading device and the barrel.

Another problem with this loading device is that it does not facilitate the removal of jammed projectiles. It is not unusual for a pellet to become jammed in the barrel of a pellet gun. Sometimes a user will cause two or more pellets to jam in the barrel, and some users attempt to fire odd-shaped projectiles from the gun which will lodge in the barrel. The usual procedure for clearing a jammed projectile is to force a ram rod down the barrel to force the projectile back toward its firing position. Since the loading device is not removable, the projectile must be positioned in the bore of the loader so that the loader can be moved upwardly to its loading position to expose the projectile. However, if the projectile is forced too far back, the loader can become jammed in its firing position. If more than one projectile is jammed in the barrel, or if an odd-shaped projectile is jammed, it could be very difficult to force the jammed projectile into proper alignment with the loader bore so that the loader can be moved to its loading position.

SUMMARY OF THE INVENTION

The invention provides a loading device which is easily removable from the gun to facilitate removal of a jammed projectile in the gun. The loader is rectangularly shaped and is slidably mounted in a rectangular slot behind the barrel. When the loader is removed, a jammed projectile can be forced into the slot where it is free to fall out of the gun. The loader is provided with a bore for loading a pellet, and the bore is aligned with the barrel when the loader is lowered to its firing position. However, the pellet is fired from the barrel rather than from the loader since the gun bolt pushes the pellet from the loader into the barrel when the bolt is moved to its firing position. This eliminates the requirement of precisely aligning the bore of the loader and the bore of the barrel and permits ordinary manufacturing tolerances to be observed. Firing the pellet from the barrel also reduces the leakage of propellant gas through the space between the barrel and the loader since the bolt closes the barrel behind the pellet. Although the loader facilitates the loading of a pellet into the gun, the loader does not interfere with the ability of the gun to be operated as a BB repeater.

DESCRIPTION OF THE DRAWING

The invention will be explained in conjunction with an illustrative embodiment shown in the accompanying drawing, in which:

FIG. 3 is a fragmentary sectional view similar to FIG. 1 with the gun shown in the loading position;

FIG. 6 is a perspective view of the front end of the loader;

FIG. 7 is a side elevational view of the right side of the loader;

FIG. 8 is a side elevational view of the left side of the loader; and

FIG. 9 is a sectional view of the loader taken along the line 9—9 of FIG. 4.

DESCRIPTION OF SPECIFIC EMBODIMENT

Figures 1, 2, 4, 5:
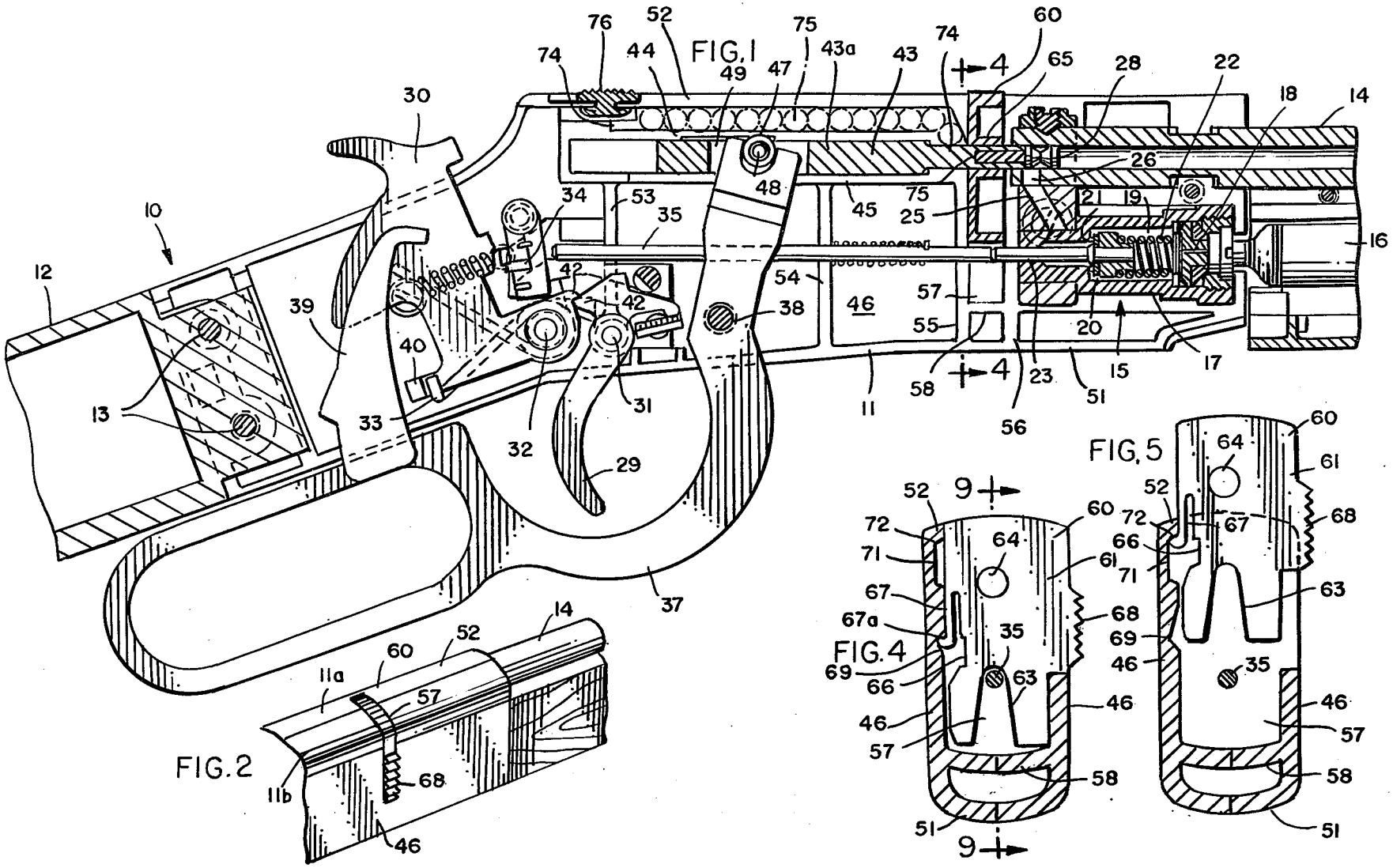
FIG. 1 is a fragmentary sectional view of a rifle equipped with a loading device in accordance with the invention, the gun being shown in the firing position.
FIG. 2 is a fragmentary perspective view of the gun.
FIG. 4 is a sectional view taken along the line 4—4 of FIG. 1.
FIG. 5 is a sectional view similar to FIG. 4 showing the loader in the loading position.

The numeral 10 designates generally a rifle comprising a frame or receiver 11 comprised of a pair of mating halves 11*a* and 11*b* (FIG. 2), a stock 12 secured to the receiver by screws 13, and a barrel 14. The particular gun illustrated is a gas-operated BB and pellet rifle, but it will be understood that the invention can be used with other types of guns.

The gun includes a conventional valve assembly 15 which transmits $CO_2$ gas from a $CO_2$ cartridge 16 to the barrel. The valve assembly includes a valve body 17, a hollow piercing pin 18 for puncturing the cartridge, a gas chamber 19 in the valve body, and a resilient sealing ring 20 which is urged against a valve seat 21 to seal the chamber by a spring 22. The sealing ring is movable to the right to open the chamber by a valve stem 23. When the valve is opened, pressurized $CO_2$ gas flows from the chamber 19 to the barrel through a passage 25 in the valve body and a port 26 in the barrel.

A pellet 28 is shown in its firing position in the barrel. As will be explained in detail hereinafter, the pellet is positioned so that the rear or left end of the pellet is just forward of the rear of the port 26 so that pressurized gas which flows through the port when the gun is fired will propel the pellet forwardly out of the barrel.

The gun is fired by pulling the trigger 29 which releases the hammer 30 from its cocked position illustrated in FIG. 1. The trigger pivots about pin 31, and the hammer pivots about pin 32. When the trigger is pulled, the hammer, which is biased to pivot clockwise by a torsion spring 33, strikes a hammer link 34 to move a valve stem extension rod 35 to the right to open the $CO_2$ valve 15. The particular trigger, hammer, and safety link shown in the drawing are described in detail in our co-pending United States patent application entitled "Safety Link For Firing Mechanism Of A Gun", Ser. No. 814,897 filed concurrently herewith, which is incorporated herein by reference. However, any conventional firing means for supplying pressurized gas to the barrel for discharging the projectile 28 can be used.

The hammer is cocked by a lever 37 which is pivotally mounted in the receiver by a screw 38. A hook 39 on the lever is engageable with a laterally projecting lug 40 on the rear of the hammer to pivot the hammer counterclockwise to its cocked position illustrated in both FIGS. 1 and 3. The hammer is held in the cocked position by mating sear surfaces 41 and 42 on the hammer and trigger, respectively.

The cocking lever 37 also operates a bolt 43 which is slidably mounted in the receiver in axial alignment with the bore of the barrel 14. The particular bolt illustrated includes a main portion **43*a* which is rectangular in both longitudinal and transverse cross section and which is slidably mounted between upper and lower parallel walls 44 and 45 which extend laterally inwardly from the outer side wall 46 of each of the receiver halves. The upper end of the cocking lever engages a roller bearing 47 which is rotatably mounted on a pin 48 which extends across a recess 49** in the bolt.

Each of the receiver halves includes a bottom wall 51 and a top wall 52 (see also FIGS. 2 and 4) and transversely extending walls 53, 54, 55, and 56 which extend laterally inwardly from the side wall 46. The valve stem extension rod extends slidably through openings in the walls 53–55, and the valve stem 23 extends slidably through the wall 56. A generally rectangular slot 57 is provided between the walls 55 and 56, and the upper wall of each of the receiver halves and a portion of the right side wall 46 is cut away as shown in FIGS. 2, 4, and 5 so that the slot 57 is open along about ¼ of the periphery of the receiver. The walls 55 and 56 which define the recess are reinforced by a lower wall 58.

A pellet loader 60 is slidably positioned in the recess 57 between the walls 55 and 56. Referring to FIGS. 4–9, the pellet loader has a generally rectangular outer periphery and includes a planar wall or central portion 51 and a perimetric flange 62 which extends forwardly from the central portion. The lower portion of the central portion is notched at 63 to accommodate the valve stem extension rod 35 and the valve stem 23, which extend into the slot 57 (see FIGS. 1 and 4). The central portion is provided with a bore 64 which is reinforced by an annular flange 65. The left side of the loader is recessed laterally inwardly at 66, and a solid tab or finger portion 67 extends downwardly laterally outwardly of the recessed portion. The tab is flexible and resiliently connected to the remainder of the loader so that it can be flexed laterally inwardly into the recess 66. A knurled projection 68 extends laterally outwardly from the right side of the loader. The loader is advantageously formed integrally by molding from plastic.

As shown in FIGS. 3–5, the loader is sized to slide freely up and down between the walls 55 and 56 of the receiver when the bolt is pulled rearwardly by moving the cocking lever 37 to its cocking position shown in FIG. 3. Referring to FIG. 5, when the loader is in the down or loading position, the bottom of the tab 67, which extends laterally outwardly to provide a shoulder **67*a*, is received in a recess 69 in the left side wall of the receiver. The cooperation between the flexible and resilient tab and the recess 69 retains the loader in the loading position and aligns the bore 64 of the loader with the bore 70 of the barrel as shown in FIG. 1**.

When the loader is raised from its FIG. 1 position to the loading position illustrated in FIGS. 3 and 5, the tab 67 of the loader is cammed inwardly by the smoothly curved walls of the somewhat shallow recess 69. When the laterally projecting end portion of the tab reaches the recess 71 in the upper portion of the left side wall of the receiver, the resilient tab arm flexes outwardly. The laterally extending shoulder **67*a* is engageable with an upper shoulder 72 of the recess to prevent the loader from being raised beyond the loading position illustrated in FIGS. 3 and 5. In this position the bore 64 of the loader is positioned slightly above the top wall of the receiver so that the pellet 28 shown in FIG. 3 can be inserted into the bore. The knurled projection 68** on the right side of the loader, which extends laterally outwardly through the slot in the right side wall of the receiver, facilitates raising and lowering the loader.

After the pellet is inserted into the loader, the loader is pushed downwardly to the firing position of FIGS. 1 and 4. The bottom of the tab 67 is rounded and is cammed inwardly by the lower shoulder of the recess 71 to permit the loader to move downwardly. After the loader is moved to its firing position, the cocking lever can be pivoted clockwise to move the bolt 43 forwardly. The bolt includes a cylindrical forward end portion 74 which is sized to fit the bore 70 of the barrel rather snugly, and as the bolt moves forwardly it passes through the bore of the loader and moves the pellet 28 into the barrel. A magnet 75 is carried by the forward end of the bolt to prevent the projectile from falling out of the bore.

When the cocking lever is in its FIG. 1 position, the bolt extends through the loader, and the loader cannot be raised. The loader will therefore be retained in its firing position until the gun if fired and the cocking lever is again cocked.

The gun is fired by pulling the trigger to release the hammer. The stored energy of the hammer spring is transmitted to the valve extension rod 35 to open the $CO_2$ valve and to release an appropriate amount of pressurized $CO_2$ gas from the chamber 19 of the valve assembly. The gas flows through the passage 25 and the port 26 into the barrel to propel the pellet 28 out of the barrel. The cylindrical end 74 of the bolt substantially seals the barrel behind the pellet and minimizes leakage of $CO_2$ gas rearwardly into the loader slot 57. Accordingly, substantially all of the $CO_2$ charge which is released each time the gun is fired is used to propel the pellet, and more power and a greater number of firings from each $CO_2$ cartridge is obtained. Since the pellet is fired from the barrel and not from the loader, the bores of the loader and the barrel do not have to be precisely aligned. This permits greater stacking tolerances between the loader and the receiver and facilitates manufacture.

After the gun is fired, another pellet can be loaded and fired by first lowering the cocking lever to withdraw the bolt from the loader and to cock the hammer. The loader can then be raised to its loading position shown in FIGS. 3 and 5.

If a projectile becomes jammed in the barrel, the loader can be completely removed from the receiver by first moving the loader to the loading position (FIG. 5). The upper end of the flexible and resilient tab 67 extends slightly above the top wall 52 of the receiver and can be pressed inwardly by a finger to move the shoulder 67*a* out of engagement with the upper shoulder 72 of the recess in the receiver. The loader can then be withdrawn upwardly from the receiver.

After the loader has been removed, a ram rod can be inserted into the muzzle end of the barrel and pushed downwardly to force the projectile into the slot 57 which has been vacated by the loader. Thereafter, the gun is merely turned upside down to allow the projectile to fall out of the slot. The loader can be reinserted merely by pushing the loader downwardly into the slot 57.

Although the loader is slidably mounted in the receiver to permit pellets to be loaded individually and is removable from the receiver to permit jammed projectiles to be cleared from the barrel, the loader does not interfere with operation of the gun as a BB repeater. The top wall 52 of the receiver and the horizontal wall 44 which is spaced just below the top wall form a magazine or chamber 74 for storing a plurality of BB's which are indicated in phantom at 75. A magazine cover 76 is slidably mounted in a slot between the two receiver halves for opening and closing a loading port for the BB magazine. The BB's are shown in phantom in the drawings since the magazine should be emptied of the BB's before the gun is used to fire pellets.

When the gun is used as a BB repeater, the BB magazine is filled with BB', and the pellet loader 60 is retained in the firing position illustrated in FIG. 1. When the gun is cocked by pivoting the cocking lever 27 counterclockwise and the bolt 43 is moved rearwardly, the forwardmost BB in the BB chamber can fall by gravity through an opening 78 (FIG. 3) in the transverse wall 55, past the forward end of the bolt, and into the bore 64 of the loader. When the bolt is moved forwardly by the cocking lever, the BB is pushed into the barrel where it can be propelled from the barrel by pressurized $CO_2$ which passes through the port 26 of the barrel. Each time the gun is cocked, a BB falls from the magazine into the pellet loader and is pushed into the barrel by the bolt.

While in the foregoing specification a detailed description of a specific embodiment of the invention was set forth for the purpose of illustration, it will be understood that many of the details hereingiven may be varied considerably by those skilled in the art without departing from the spirit and scope of the invention.

We claim:

1. In a gas-operated gun having a frame, a barrel mounted on the frame, means for supplying pressurized gas to the barrel for discharging a projectile in the barrel, and a bolt mounted in the frame for reciprocation in a direction aligned with the axis of the barrel, the bolt having a forward end sized to fit into the barrel and being movable between a firing position in which the front end of the bolt is positioned in the barrel and a loading position in which the front end of the bolt is spaced rearwardly of the barrel, an improved projectile loader slidably mounted in a slot in the frame rearwardly of the barrel, the loader having a bore extending therethrough and being movable between a firing position in which the bore is axially aligned with the barrel and a loading position in which the bore is positioned outside of the frame, the front end of the bolt extending through the bore of the loader into the barrel when the loader and bolt are in their firing positions whereby a projectile in the bore of the loader is moved into the barrel by the bolt and the loader is retained in its firing position by the bolt, the loader being slidable to its loading position when the bolt is moved to its loading position whereby a projectile can be loaded into the bore of the loader, the frame including a magazine rearwardly of the slot for the loader for storing BB's, the magazine having an outlet opening adjacent the bore of the loader when the loader is in the firing position and the front end of the bolt being spaced rearwardly from the loader when the bolt is in the loading position a sufficient distance to permit a BB from the magazine to move into the bore of the loader whereby the barrel can be loaded with a BB without moving the loader to its loading position.

2. The structure of claim 1 in which the loader is integrally molded from plastic and includes a flexible and resilient arm portion which is engageable with a recess in the frame when the loader is in the loading position to restrain removal of the loader from the frame, the arm being flexible out of engagement with the recess to permit removal of the loader from the frame.

3. The structure of claim 2 in which a portion of the flexible and resilient arm of the loader is positioned outside of the frame when the loader is in its loading position whereby the arm can be pressed out of engagement with the recess to permit the loader to be removed from the frame.

4. In a gun having a frame, a barrel mounted on the frame, and means for discharging a projectile from the barrel, an improved projectile loader slidably mounted in a slot in the frame for sliding movement in a direction transverse to the axis of the barrel, the loader having a bore extending therethrough and being movable between a firing position in which the bore is axially aligned with the barrel and a loading position in which the bore is positioned outside of the frame, the loader being integrally molded from plastic and including a flexible and resilient arm portion which is engageable with a recess in the frame when the loader is in the loading position to restrain removal of the loader from the frame, a portion of the flexible and resilient arm of the loader being positioned outside of the frame when the loader is in its loading position whereby the arm can be pressed out of engagement with the recess to permit the loader to be removed from the frame.

5. In a gas-operated gun having a frame, a barrel mounted on the frame, means for supplying pressurized gas to the barrel for discharging a projectile in the barrel, and a bolt mounted in the frame for reciprocation in a direction aligned with the axis of the barrel, the bolt having a forward end sized to fit into the barrel and being movable between a firing position in which the front end of the bolt is positioned in the barrel and a loading position in which the front end of the bolt is spaced rearwardly of the barrel, an improved projectile loader slidably mounted in a slot in the frame rearwardly of the barrel, the loader having a bore extending therethrough and being movable between a firing position in which the bore is axially aligned with the barrel and a loading position in which the bore is positioned outside of the frame, the front end of the bolt extending through the bore of the loader into the barrel when the loader and bolt are in their firing positions whereby a projectile in the bore of the loader is moved into the barrel by the bolt and the loader is retained in its firing position by the bolt, the loader being slidable to its loading position when the bolt is moved to its loading position whereby a projectile can be loaded into the bore of the loader, the loader being integrally molded from plastic and including a flexible and resilient arm portion which is engageable with a recess in the frame when the loader is in the loading position to restrain removal of the loader from the frame, a portion of the flexible and resilient arm of the loader being positioned outside of the frame when the loader is in its loading position whereby the arm can be pressed out of engagement with the recess to permit the loader to be removed from the frame.

* * * * *